US009818597B2

(12) United States Patent
Neate

(10) Patent No.: US 9,818,597 B2
(45) Date of Patent: Nov. 14, 2017

(54) LUCENT WAVEGUIDE PLASMA LIGHT SOURCE

(76) Inventor: Andrew Simon Neate, Buckinghamshire (GB)

( * ) Notice: Subject to any disclaimer, the term of this patent is extended or adjusted under 35 U.S.C. 154(b) by 0 days.

(21) Appl. No.: 14/125,114

(22) PCT Filed: Jun. 28, 2012

(86) PCT No.: PCT/GB2012/000554
§ 371 (c)(1),
(2), (4) Date: Apr. 1, 2014

(87) PCT Pub. No.: WO2013/004988
PCT Pub. Date: Jan. 10, 2013

(65) Prior Publication Data

US 2014/0197729 A1 Jul. 17, 2014

(30) Foreign Application Priority Data

Jul. 1, 2011 (GB) ..... 1111292.7
Jul. 1, 2011 (GB) ..... 1111293.5

(51) Int. Cl.
*H01J 65/04* (2006.01)
*H01J 9/24* (2006.01)

(52) U.S. Cl.
CPC ..... *H01J 65/044* (2013.01); *H01J 9/247* (2013.01)

(58) Field of Classification Search
CPC ..... H01J 65/04; H01J 65/42; H01J 65/044; H01J 65/046; H01J 65/042
USPC ..... 315/39
See application file for complete search history.

(56) References Cited

U.S. PATENT DOCUMENTS

| | | | | |
|---|---|---|---|---|
| 8,814,620 | B2 * | 8/2014 | Pothoven et al. | 445/22 |
| 2006/0250090 | A9 * | 11/2006 | Guthrie et al. | 315/39 |
| 2010/0219754 | A1 * | 9/2010 | Odell et al. | 313/634 |

FOREIGN PATENT DOCUMENTS

| | | |
|---|---|---|
| GB | EP 0422816 | 4/1991 |
| GB | WO 2009063205 | 5/2009 |
| GB | WO 2010/094938 | 8/2010 |
| GB | WO 2011/048359 | 4/2011 |
| GB | EP 2 188 829 | 6/2011 |

* cited by examiner

*Primary Examiner* — Benny Lee
(74) *Attorney, Agent, or Firm* — Jennifer Meredith, Esq.; Meredith & Keyhani, PLLC

(57) ABSTRACT

A lucent waveguide plasma light source has a quartz waveguide body with a central through bore. The bore has orifices at its opposite ends, opening centrally of flat, end faces of the body. Between these the body has a circular cylindrical periphery. A drawn quartz tube is inserted into the body. The tube has its one end closed and a collar which locates the tube in the bore and is fused to the faces at the orifices of the bore. The tube is evacuated and charged with excitable material and closed as a sealed void. A Faraday cage and an antenna in a bore in the body are provided for feeding microwave energy to the light source. When powered with microwaves, resonance is established in the wave guide and a plasma is established in the void, wherein Light radiates and leaves the waveguide and Faraday cage radially of the periphery.

19 Claims, 2 Drawing Sheets

LUCENT WAVEGUIDE PLASMA LIGHT SOURCE

BACKGROUND OF THE INVENTION

The present invention relates to a plasma light source.

In European Patent No EP1307899, granted in our name there is claimed a light source comprising a waveguide configured to be connected to an energy source and for receiving electromagnetic energy, and a bulb coupled to the waveguide and containing a gas-fill that emits light when receiving the electromagnetic energy from the waveguide, characterized in that:

(a) the waveguide comprises a body consisting essentially of a dielectric material having a dielectric constant greater than 2, a loss tangent less than 0.01, and a DC breakdown threshold greater than 200 kilovolts/inch, 1 inch being 2.54 cm, (b) the wave guide is of a size and shape capable of supporting at least one electric field maximum within the wave guide body at least one operating frequency within the range of 0.5 to 30 GHz, (c) a cavity depends from a first side of the waveguide, (d) the bulb is positioned in the cavity at a location where there is an electric field maximum during operation, the gas-fill forming a light emitting plasma when receiving microwave energy from the resonating waveguide body, and (e) a microwave feed positioned within the waveguide body is adapted to receive microwave energy from the energy source and is in intimate contact with the waveguide body.

In our European Patent No 2,188,829 there is described and claimed a light source to be powered by microwave energy, the source having:

a body having a sealed void therein, a microwave-enclosing Faraday cage surrounding the body, the body within the Faraday cage being a resonant waveguide, a fill in the void of material excitable by microwave energy to form a light emitting plasma therein, and an antenna arranged within the body for transmitting plasma-inducing, microwave energy to the fill, the antenna having:

a connection extending outside the body for coupling to a source of microwave energy;

wherein:

the body is a solid plasma crucible of material which is lucent for exit of light therefrom, and the Faraday cage is at least partially light transmitting for light exit from the plasma crucible, the arrangement being such that light from a plasma in the void can pass through the plasma crucible and radiate from it via the cage.

We refer to this as our Light Emitting Resonator or LER patent. Its main claim as immediately above is based, as regards its prior art portion, on the disclosure of our EP1307899, first above.

We have filed LER improvement and modification applications published under Nos: EP 2 399 269, EP 2 438 606, EP 2 430 647, and WO2011073623 (the Improvement Applications).

In our European Patent Application No 08875663.0, published under No WO2010055275, there is described and claimed a light source comprising:

a lucent waveguide of solid dielectric material having:

an at least partially light transmitting Faraday cage surrounding the waveguide, the Faraday cage being adapted for light transmission radially, a bulb cavity within the waveguide and the Faraday cage and an antenna re-entrant within the waveguide and the Faraday cage and a bulb having a microwave excitable fill, the bulb being received in the bulb cavity.

We refer to this as our Clam Shell application, in that the lucent wave guide forms a clam shell around the bulb.

As used in our LER patent, our LER Improvement Applications, our Clam Shell application and this specification:

"microwave" is not intended to refer to a precise frequency range. We use "microwave" to mean the three order of magnitude range from around 300MHz to around 300GHz;

"lucent" means that the material, of which an item described as lucent is comprised, is transparent or translucent;

"plasma crucible" means a closed body enclosing a plasma, the latter being in the void when the void's fill is excited by microwave energy from the antenna;

"Faraday cage" means an electrically conductive enclosure of electromagnetic radiation, which is at least substantially impermeable to electromagnetic waves at the operating, i.e. microwave, frequencies.

The LER patent, the Clam Shell Applications and the above LER improvement applications have in common that they are in respect of:

A lucent waveguide plasma light source, having:

a fabrication of solid-dielectric, lucent material, having;

a closed void containing electro-magnetic wave excitable material, normally microwave excitable material; and a Faraday cage:

delimiting a waveguide, being at least partially lucent, and normally at least partially transparent, for light emission from it, normally having a non-lucent closure and enclosing the fabrication;

provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

In this specification, we refer to a Lucent Waveguide Plasma Light Source as a LUWPL.

Insofar as the lucent material may be of quartz and/or may contain glass, which materials have certain properties typical of solids and certain properties typical of liquids and as such are referred to as super-cooled liquids, super-cooled liquids are regarded as solids for the purposes of this specification.

In the preferred embodiment of our LER patent, the void is formed directly in the lucent waveguide, which is generally a quartz body. This can result in problems if the plasma causes micro-cracking of the material of the waveguide, which then propagate through the body.

In our Clam Shell application, this problem is not present in that a quartz bulb having the void and excitable material is provided distinct from and inserted into the lucent wave guide. The waveguide may be formed of two halves captivating the bulb between them or a single body having a bore in which the bulb is received.

BRIEF SUMMARY OF THE INVENTION

Summary of the Invention

The object of the present invention is to provide an improved LUWPL in which the benefits of the LER patent are achieved, with a structure akin to that of the Clam Shell application.

According to the invention there is provided a lucent waveguide plasma light source, having:

a fabrication of solid-dielectric, lucent material, having;
- a closed void containing electro-magnetic wave excitable material, normally microwave excitable material; and a Faraday cage:
- delimiting a waveguide,
- being at least partially lucent, and normally at least partially transparent, for light emission from it,
- normally having a non-lucent closure and
- enclosing the fabrication;

provision for introducing plasma exciting electro-magnetic waves, normally microwaves, into the waveguide;

the arrangement being such that on introduction of electromagnetic waves, normally microwaves of a determined frequency, a plasma is established in the void and light is emitted via the Faraday cage, and wherein the fabrication includes:

a lucent waveguide body having a bore and a lucent tube in the bore, the tube providing the closed void and the tube having:
- a first closed end and a second closed end and
- a fusion between the body and the tube at an orifice of the bore at or close to the first closed end of the tube wherein the void extends at least to the fusion between the body and the tube at the orifice of the bore.

Preferably, the tube is formed with a swelling at the fusion between the body and the tube, at a position to locate the tube with respect to the body.

It is envisaged that the void can extend beyond the fusion and/or the swelling of the tube. However, it is preferred that the void extends to the fusion and/or the swelling of the tube.

Typically, one end of the tube will be closed before insertion in the bore.

It is possible in theory for the tube to be a bulb formed prior to being fused to the waveguide body. However, it is preferred that the void be closed with the excitable material captivated therein after the tube is fused to the body.

Whilst it is envisaged that the lucent waveguide body and the lucent tube can be of different material, preferably they are of the same material, normally quartz.

In a first embodiment of the invention, preferably:

the bore is a through-bore, the bore in the waveguide body is bored and polished to an internal diameter such as to receive the tube with a sliding fit, the tube is formed with a swelling/collar at substantially the length of the bore from the end closure, the tube is fused to the body at both bore orifices, the tube was fused to the body at both bore orifices prior to filling with the plasma material and closure.

In a second embodiment of the invention, preferably:

the bore in the waveguide body is bored and polished, an annular gap is provided between the bore and the tube, the tube is formed with a collar at a position to locate the tube with respect to the body, the second closed end of the tube is free within the bore, the bore is closed and evacuated or filled with inert gas and the tube was fused to the body at the orifice of the bore prior to filling with the plasma material and closure.

BRIEF DESCRIPTION OF THE INVENTION

To help understanding of the invention, a specific embodiment thereof will now be described by way of example and with reference to the accompanying drawings, in which.

DETAILED DESCRIPTION OF THE INVENTION

Figure 1:
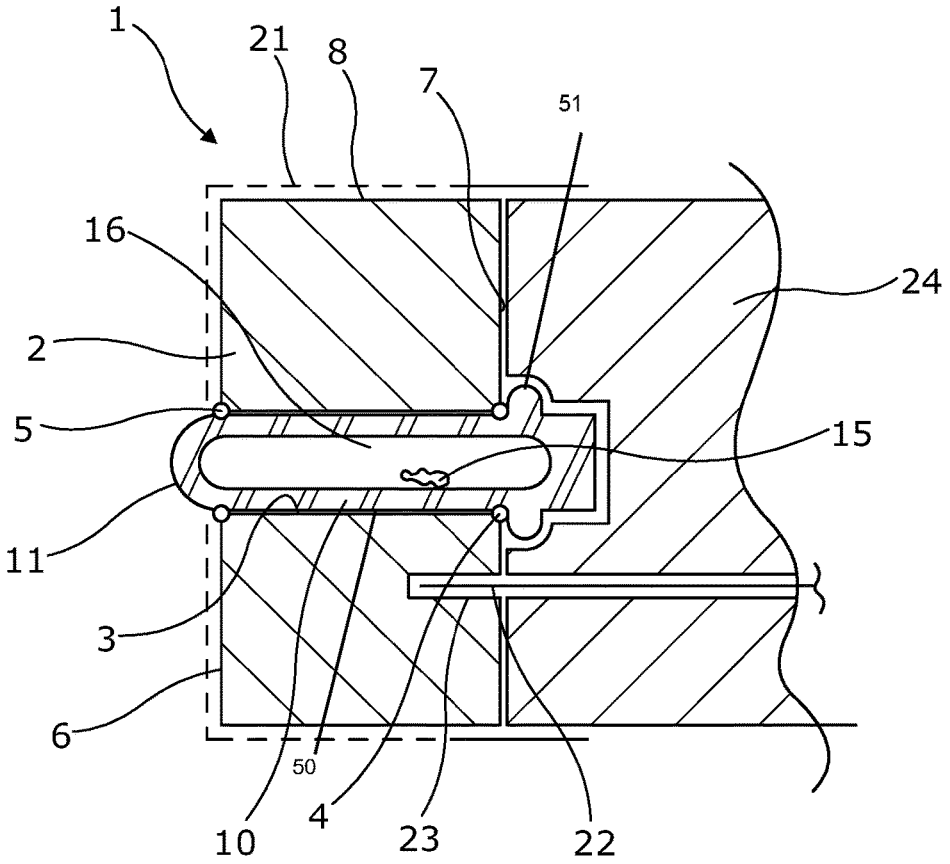
FIG. 1 is a cross-sectional view of a Lucent Waveguide Plasma Light Source according to the invention.
Figure 2:
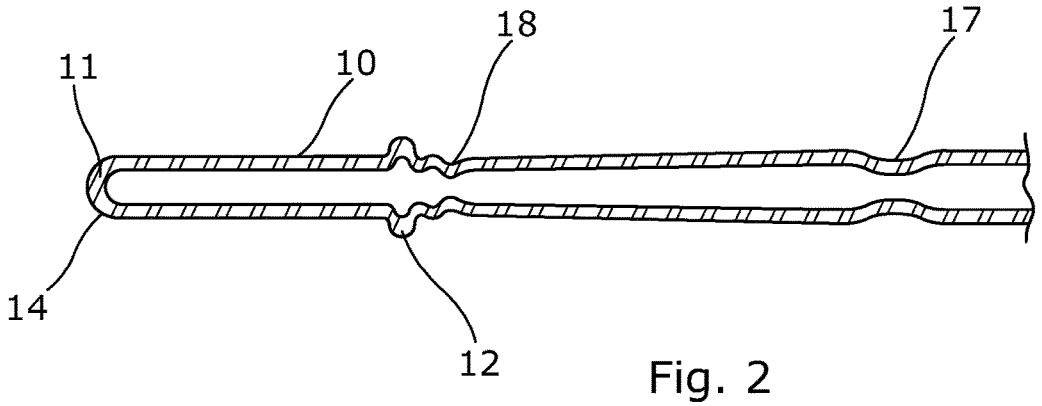
FIG. 2 is a similar view of a plasma void tube used in manufacture of the light source of FIG. 1.

Referring to FIGS. 1 and 2, a LUWPL 1 (FIG. 1) has a quartz waveguide body 2 (FIG. 1) which has a short, 20 mm length and has a circular, 49 mm outside diameter. It has a central, 6 mm through bore 3 (FIG. 1). The bore is polished to optical smoothness, but need not be polished to the extent of removing all possibility of micro-cracks into the body of the quartz. As shown in FIG. 1, the bore has orifices 4, at its opposite ends, opening centrally of flat, end faces 6, 7 (FIG. 1) of the body The body has a circular cylindrical periphery 8. The tube may be formed with a swelling 51 (FIG. 1) at the fusion between the body and the tube, at a position to locate the tube with respect to the body.

After boring, a drawn quartz tube 10 is inserted into the body. There may be an annular gap 50 (FIG. 1) between the bore 3 and the tube 10. The bore may also be filled with inert gas. There may be the step of filling the bore with an inert gas before closing the bore. It is of the same nominal size as the bore, the one being a sliding fit in the other. It has a 1 mm wall thickness. At the stage of its insertion, the tube had its one end 11 closed and a collar 12 (FIG. 2) formed 25 mm from the dome 14 (FIG. 2) of the closed end. The collar locates the tube in the bore and it is then fused to the faces 6, 7, at the orifices of the bore, by normal glass working techniques.

The tube has an extension by which it can be evacuated and charged with excitable material 15 and closed as a sealed void 16 as shown in FIG. 1. This can be done in the manner of our earlier European patent No. 1,831,916—our sealing patent. Shown in FIG. 2 are distal and proximal necks 17, 18 of the tube for first and second sealing of the tube—after it has been fused to the body.

Included in FIG. 1 are a mesh, Faraday cage 21 and an antenna 22 in a bore 23 in the body for feeding microwave energy to the light source. The Faraday cage is closed by a solid metal support 24, to which the cage is clamped. When powered with microwaves, typically as described in our LER patent and our International patent application No. PCT/GB2010/000911, resonance is established in the wave guide and a plasma is established in the void. Light from this radiates from the void and leaves the waveguide and the Faraday cage radially of the periphery 8.

Figure 3:
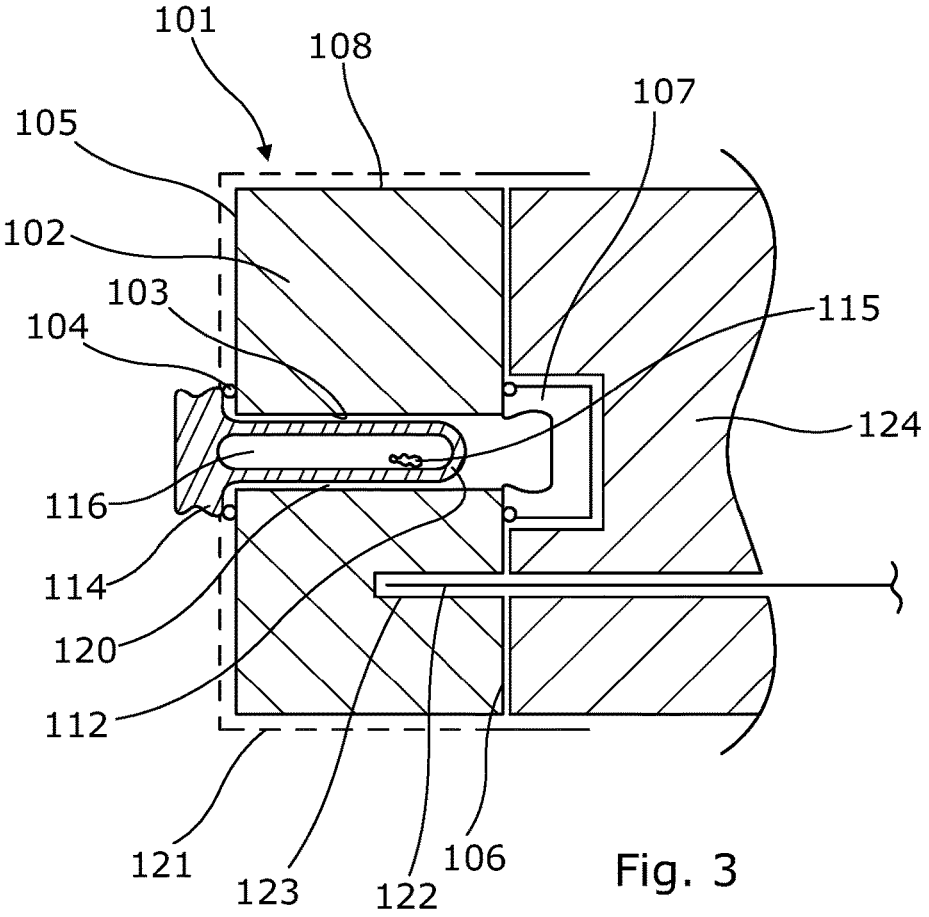
FIG. 3 is a cross-sectional view of a Lucent Waveguide Plasma Light Source according to the invention.
Figure 4:
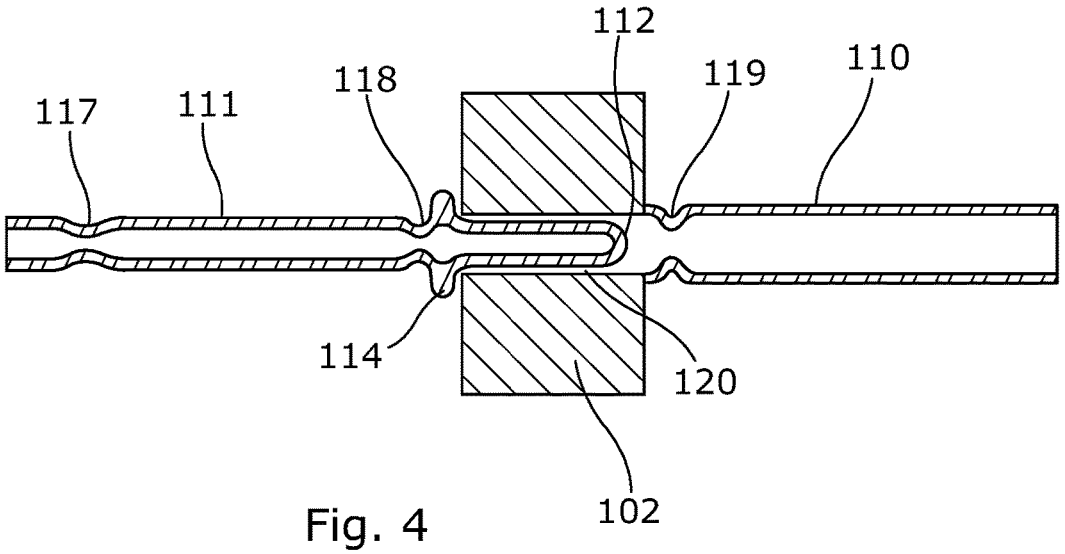
FIG. 4 is a similar view of the lucent body and two attached tubes used in manufacture of the light source of FIG. 1.

Referring to FIGS. 3 and 4, a LUWPL 101 (FIG. 3) has a quartz waveguide body 102 which has a short, 20mm length and has a circular, 49mm outside diameter. It has a central, 6mm bore 103 (FIG. 3). The bore is polished to optical clarity, but need not be polished to the extent of removing all possibility of micro-cracks into the body of the quartz. As shown in FIG. 3, the bore has an orifice 104 at its end, opening centrally of flat, end face 105 of the body. The other end face 106 has a closure 107 of the bore. Between the end faces 105, 106 of the body has a circular cylindrical periphery 108.

After making the bore 103 through the body, a 6 mm internal diameter drawn quartz tube 110 (FIG. 4) is fused to the face 106 and to be formed into the closure 107 as described below. Another 4 mm internal diameter drawn quartz tube 111 (FIG. 4) is sealed and domed off at one end 112 and formed with an upset collar 114 (as depicted in FIG. 4), 17 mm from the domed end. The sealed tube 111 is inserted into the bore with the collar locating the tube at the orifice 104 of the bore in the face 106. The collar is fused to the face at the orifice. The term "upset collar" is known within the art and describes the wavy, non-linear collar as shown in FIG. 4, as upset collar 114.

The body now has two tubes attached, the smaller one extending into the central bore and the larger one extending the bore. The smaller/inner one is evacuated and charged with excitable material 115 and closed as a sealed void 116 as shown in FIG. 3. This can be done in the manner of our earlier European patent No. 1,831,916—our sealing patent. Shown in FIG. 4 are distal and proximal necks 117, 118 of the tube for first and second sealing of the inner tube—after it has been fused to the body. The larger one 110 is also evacuated, evacuating the space around the inner one, and possibly filled with nitrogen. It is sealed in the same way as the inner one, but requires only one neck 119.

The result is that the inner quartz enclosure formed by the inner tube has its central void filled with excitable material and surround by a narrow circular cylindrical cavity 120, which insulates the inner tube, allowing it to run at higher temperatures.

Included in FIG. 3 are a mesh, Faraday cage 121 and an antenna 122 in a bore 123 in the body for feeding microwave energy to the light source. The Faraday cage is closed by a solid metal support 124, to the cage is clamped. When powered with microwaves, typically as described in our LER patent and our International patent application No. PCT/GB2010/000911, resonance is established in the wave guide and a plasma is established in the void. Light radiates from the void and leaves the waveguide and the Faraday cage radially of the periphery 108.

The invention is not intended to be restricted to the details of the above described embodiments. For instance, the bore can be drilled to be blind. The cavity 120 then remains filled with air, or any ambient atmosphere in which the inner tube is sealed, possibly a vacuum. Alternatively the bore can be a through bore and left open, again the cavity remains air filled. Air still provides appreciable insulation between the inner tube and the main body. Further, a reader familiar with our LER technology will recognize the dimensions of the LUWPL fabrication of the preferred embodiments to be suitable for the TM010 mode at 2.45 GHz, the invention is applicable to other frequencies and modes, such the TE111 mode. Such a fabrication for 2.45 GHZ would be 44 mm in outside diameter and 64 mm long, i.e. slightly smaller in diameter but longer. This mode has the advantage of higher Q at a higher wattage.

The invention claimed is:

1. A fabrication for a lucent waveguide plasma light source of solid-dielectric, lucent material, the fabrication having:

a closed void containing electro-magnetic wave excitable material wherein the fabrication includes:

a lucent waveguide body having a bore and a lucent tube in the bore, the tube providing the closed void and the tube having:

a first closed end and a second closed end and a fusion between the body and the tube at an orifice of the bore at or close to the first closed end of the tube and wherein the void extends at least to the fusion between the body and the tube at the orifice of the bore, and the tube is formed with a swelling at the fusion between the body and the tube, and the swelling is outside the body.

2. A lucent waveguide plasma light source, having:

a fabrication of solid-dielectric, lucent material, having;

a closed void containing electro-magnetic wave excitable material; a lucent waveguide body; and a Faraday cage:

delimiting a waveguide, being at least partially lucent, at least partially transparent, for light emission therefrom, having a non-lucent closure and enclosing the fabrication;

provision for introducing electro-magnetic waves into the waveguide; the arrangement being such that upon introduction of the electro-magnetic waves of a determined frequency, a plasma is established in the closed void and light is emitted via the Faraday cage, and wherein the fabrication includes:

the lucent waveguide body having a bore and a lucent tube in the bore, the tube providing the closed void and the tube having:

a first closed end and a second closed end and a fusion between the body and the tube at an orifice of the bore at or close to the first closed end of the tube, wherein the void extends at least to the fusion between the body and the tube at the orifice of the bore, and the tube is formed with a swelling at the fusion between the body and the tube, and the swelling is outside the body.

3. A lucent waveguide plasma light source as claimed in claim 1, wherein the void extends beyond the fusion and/or the swelling of the tube.

4. A lucent waveguide plasma light source as claimed in claim 1, wherein the second closed end of the tube is free within the bore.

5. A lucent waveguide plasma light source as claimed in claim 1, wherein the tube has a second fusion between the body and the tube at another orifice of the bore, wherein the bore is a through-bore.

6. A lucent waveguide plasma light source as claimed in claim 1, wherein the bore in the waveguide body is bored and polished to an internal diameter such as to receive the tube with a sliding fit.

7. A lucent waveguide plasma light source as claimed in claim 1, wherein an annular gap is provided between the bore and the tube.

8. A lucent waveguide plasma light source as claimed in claim 1, wherein the lucent tube is evacuated.

9. A lucent waveguide plasma light source as claimed in claim 1, wherein the lucent tube is filled with inert gas.

10. A lucent waveguide plasma light source as claimed in claim 1, wherein the bore is open at least one end.

11. A lucent waveguide plasma light source as claimed in claim 1, wherein the lucent waveguide body and the lucent tube are comprised of the same material.

12. A lucent waveguide plasma light source as claimed in claim 1, wherein the lucent waveguide body and the lucent tube are comprised of different materials.

13. A lucent waveguide plasma light source as claimed in claim 1, wherein at least one of the lucent waveguide body and the lucent tube is quartz.

14. A method of making a fabrication for a lucent waveguide plasma light source, the method consisting in the steps of:

providing a lucent waveguide body with a bore and a lucent tube;

closing an end of the lucent tube;

forming a swelling in the lucent tube at a position to locate the lucent tube with respect to the lucent waveguide body;

inserting the lucent tube into the bore in the lucent waveguide body;

fusing the lucent tube to the lucent waveguide body at at least a first orifice of the bore;

charging the lucent tube with an excitable material; and closing another end of the tube to form a void containing the excitable material;

wherein the void extends at least to the fusion between the body and the tube at the orifice of the bore, and the tube is formed with a swelling at the fusion between the body and the tube, and the swelling is outside the body.

15. A method of making a lucent waveguide plasma light source as claimed in claims 14, further consisting of the steps of:

evacuating the lucent tube, and closing the lucent tube.

16. A method of making a lucent waveguide plasma light source as claimed in claim 15, further consisting of the step of filling the lucent tube with an inert gas before closing the lucent tube.

17. A method of making a lucent waveguide plasma light source as claimed in claim 14, further consisting of the step of fusing the tube to the body at a second orifice of the bore.

18. A method of making a lucent waveguide plasma light source as claimed in claim 14, wherein the lucent tube is inserted into the bore and fused to the body of the waveguide at at least the first orifice of the bore prior to charging the tube with the excitable material and closing the tube.

19. A method of making a lucent waveguide plasma light source as claimed in claim 14, wherein the lucent tube is inserted into the bore and fused to the body of the waveguide at at least the first orifice of the bore after charging the tube with the excitable material and closing the tube.

* * * * *